US006007412A

United States Patent [19]

Hutchins

[11] Patent Number: 6,007,412

[45] Date of Patent: Dec. 28, 1999

[54] ROTARY ABRADING OR POLISHING TOOL

[75] Inventor: Donald Hutchins, Sierra Madre, Calif.

[73] Assignee: Hutchins Manufacturing Company, Pasadena, Calif.

[21] Appl. No.: 09/016,011

[22] Filed: Jan. 30, 1998

[51] Int. Cl.[6] ..... B24B 5/00

[52] U.S. Cl. ..... 451/295; 451/359

[58] Field of Search ..... 451/295, 359, 451/353, 259

[56] References Cited

U.S. PATENT DOCUMENTS

| | | | |
|---|---|---|---|
| 1,667,329 | 4/1928 | Menzel | 451/359 |
| 2,326,396 | 8/1943 | Schaedler | 451/295 |
| 3,084,364 | 4/1963 | Hutchins . | |
| 3,110,993 | 11/1963 | Grage . | |
| 3,824,745 | 7/1974 | Hutchins . | |
| 3,934,657 | 1/1976 | Danielson | 451/359 |
| 4,145,848 | 3/1979 | Hutchins . | |
| 4,592,170 | 6/1986 | Hutchins et al. . | |
| 4,660,329 | 4/1987 | Hutchins . | |
| 4,671,019 | 6/1987 | Hutchins . | |
| 4,671,020 | 6/1987 | Hutchins . | |
| 4,986,036 | 1/1991 | Hutchins . | |
| 5,445,558 | 8/1995 | Hutchins . | |
| 5,597,348 | 1/1997 | Hutchins | 451/295 |

FOREIGN PATENT DOCUMENTS

| | | | |
|---|---|---|---|
| 0102107 | 3/1984 | European Pat. Off. | 451/359 |
| 0111748 | 9/1925 | Switzerland | 451/353 |

*Primary Examiner*—Robert A. Rose
*Attorney, Agent, or Firm*—Darby & Darby P.C.

[57] ABSTRACT

An abrading or polishing tool comprises a housing that contains a pneumatically drive motor mounted therein. A drive assembly is contained at least partially in the housing and is engaged with the motor to be driven by the motor during operation. A head is engaged with the drive assembly and includes a spindle portion, the head and spindle being rotated during operation of the motor. The head is further configured to engage a working pad for abrading or polishing a work surface. A double bearing assembly is contained within the housing and is engaged with a portion of the spindle adjacent the lower end of the spindle to substantially prevent radial play of the spindle during operation of the tool.

17 Claims, 5 Drawing Sheets

ROTARY ABRADING OR POLISHING TOOL

BACKGROUND OF THE INVENTION

1. Field of the Invention

The present invention relates to power driven tools for abrading or polishing a work surface. More particularly, the invention relates to such power driven tools that are designed to be compact and yet substantially prevent unwanted movement of internal components of the tool during use.

2. Description of the Prior Art

Power driven tools are well known and are used to perform many different functions, such as sanding, polishing, stripping, compounding, and the like. One of the most popular types of these tools is the power driven sander/polisher, which is used for either sanding or polishing the surface of a vehicle. These sander/polisher devices are typically powered by a source of air under pressure, and are designed with heads that are configured to engage various working pads to perform a corresponding function. For example, an abrading structure may be engaged with the head of the tool, the abrading structure including a sheet of sandpaper or other abrasive material for sanding down the surface of the vehicle. The tool includes a motor and a drive assembly that are operative to rotate or orbit the abrading structure at a very high angular velocity, usually thousands of revolutions per minute (RPM). In order to perform the polishing function, a suitable working pad is engaged to the tool in place of the abrading structure.

A number of the prior art sander/polisher tools are of the so-called "orbital" type, in which a working pad is driven orbitally relative to a handle body used for holding the tool. A form of such a device is disclosed in U.S. Pat. No. 3,084,364. That device includes a carrier assembly that is rotatably driven about a first axis by a motor. A working pad is eccentrically connected to the carrier for rotation about a second axis offset from the first axis, thereby causing the pad to orbit during operation of the motor. While such devices may be relatively effective in abrading or polishing a surface, they are not free from shortcomings, one of which is the relatively severe vibration that such a tool creates during use. The orbital movement of the working pad at high RPM causes a vibration that, over time, can become annoying to the operator, and can affect the operator's performance.

Orbital sander/polishers have been proposed that incorporate weights to counterbalance the offset relationship of the mass of the driven head and working pad relative to the main rotary carrier and motor. For example, see U.S. Pat. No. 4,660,329, the rights to which have been assigned to the assignee of the present invention. While such a device provides an efficient sander/polisher and greatly reduces the amount of vibration experienced in conventional orbital sanders, it incorporates a relatively elaborate structure for doing so.

Still others have proposed rotary sander/polishers which include a carrier to which is concentrically mounted a working pad for rotation about the same axis as the carrier. These devices typically reduce the amount of vibration created during use, as they include no orbitally driven components. They are often large and cumbersome, however, due to the need for elaborate gear drives to reduce the rotational speed of an air motor to a speed suitable for sanding and polishing. One attempt to reduce the bulk of such a device is an air sander available in Europe that uses a planetary gear set for reduction. That device had a relatively short useful life, however, due to a rather high degree of radial play of its output shaft, which caused the internal components to "wobble" during use. This resulted in damage to the planetary gear set and other internal components, shortening the useful life of the tool.

Accordingly, it will be apparent to those skilled in the art that there continues to be a need for an ablating and polishing tool that is compact, reliable, and easy to use. Furthermore, there exists a need for a compact ablating and polishing tool that eliminates vibration and substantially prevents radial play of the drive assembly to increase the useful life of the tool. The present invention addresses these needs and others.

SUMMARY OF THE INVENTION

Briefly, and in general terms, the present invention provides a rotary ablating and polishing tool that does not generate a significant amount of vibration during use, and that is of a relatively cost-efficient construction. The ablating and polishing tool of the present invention incorporates a double bearing assembly that engages the drive assembly adjacent the lower end thereof to substantially prevent the drive assembly from experiencing more than an allowable amount of radial play.

Thus, the ablating and polishing tool of the present invention in one preferred embodiment comprises: a housing; a motor mounted in the housing; a drive assembly contained at least partially in the housing and engaged with the motor to be driven by the motor during operation; a head engaged with the drive assembly and including a spindle portion, the head and spindle being rotated during operation of the motor, the head being configured to engage a working pad for abrading or polishing a work surface; and a double bearing assembly engaged with a portion of the spindle adjacent the lower end of the spindle to substantially prevent radial play of the spindle.

In an alternative embodiment of the present invention, the abrading and polishing tool includes the double bearing assembly in the form of a double row of ball bearings, i.e., two rows of ball bearings spaced axially from one another.

In yet another embodiment, the abrading or polishing tool of the present invention comprises: a housing; a motor contained in the housing; a drive assembly engaging the motor, the drive assembly including a shaft rotated by the motor; a bearing assembly including a double row of axially spaced apart ball bearings, the bearing assembly being engaged with the drive assembly to substantially prevent non-rotational movement of the drive assembly; and a head engaged with the drive assembly for rotation therewith, the head being configured to engage a working pad for abrading or polishing a work surface.

Other features and advantages of the present invention will become apparent from the following detailed description, taken in conjunction with the accompanying drawings which illustrate, by way of example, the features of the present invention.

DETAILED DESCRIPTION OF THE PREFERRED EMBODIMENT

Figure 1:
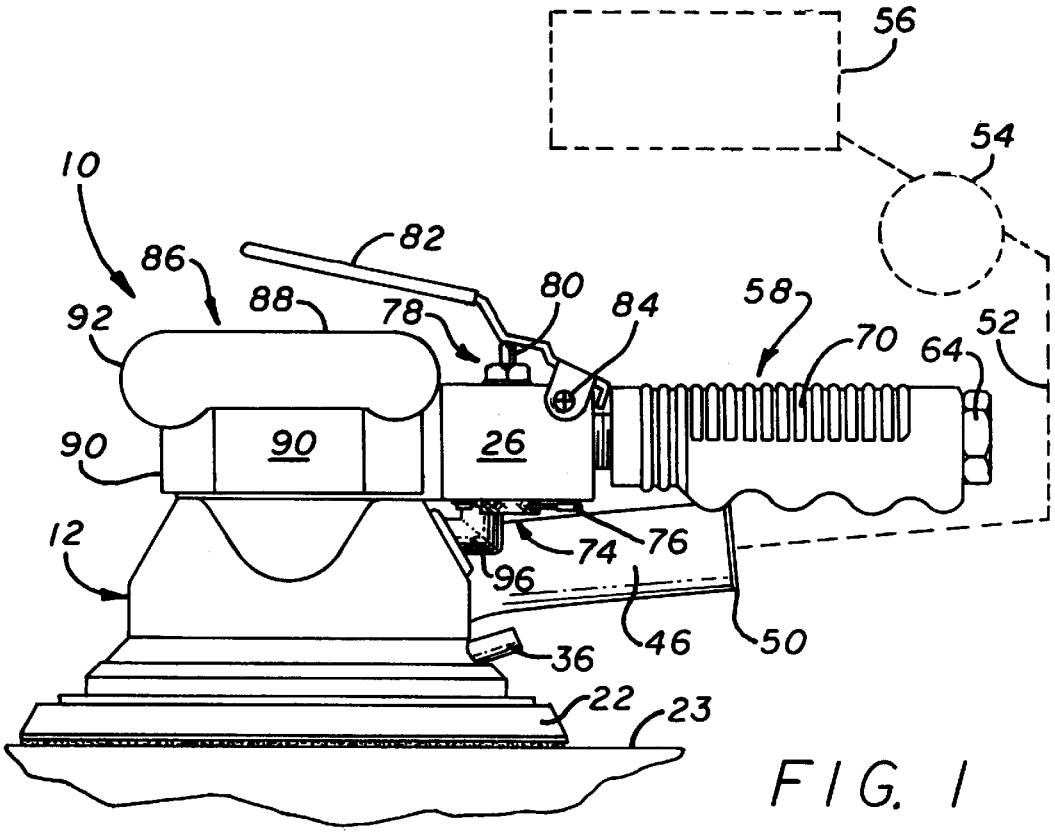
FIG. 1 is a side view of a polishing and abrading tool embodying the present invention.
Figure 3:
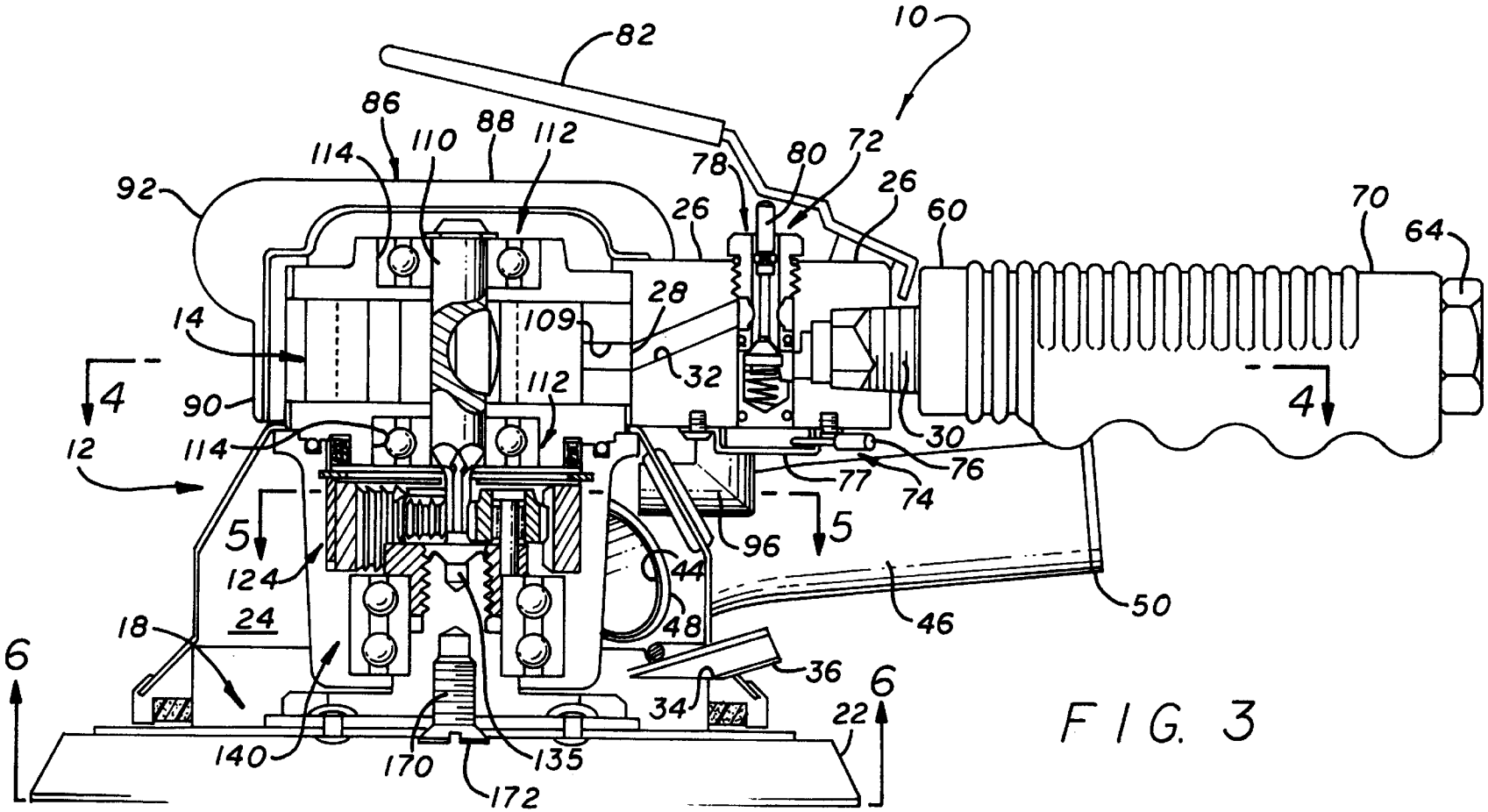
FIG. 3 is a partial vertical sectional view taken along the line 3—3 of FIG. 2 and shown in enlarged scale.

In the following detailed description, like reference numerals will be used to refer to like or corresponding elements in the different figures of the drawings. Referring now to the drawings, and particularly to FIGS. 1 and 3, there is shown, generally, a rotary abrading and polishing tool 10 comprising a preferred embodiment of the present invention. The rotary abrading and polishing tool comprises, generally, a downwardly opening housing 12 that houses a motor 14 and a drive assembly 16. The motor and drive assembly are engaged so that activation of the motor results in rotational movement of at least a head portion 18 of the drive assembly. The head is generally aligned with the downwardly opening lower end 20 of the housing 12 (FIG. 6), and is configured to engage a working pad 22, such that rotation of the head is transmitted to the working pad to rotate against a work surface 23, as described in greater detail below.

The housing 12 has a generally inverted cup shape and defines the open, generally circular lower end 20. The housing also defines an interior chamber 24 in which at least a portion of the drive assembly 16 is contained. The housing further includes an outwardly projecting, rectangular extension member 26 having an open first end 28 that opens into the motor 14, an externally threaded, open second end 30, and an internal passageway 32 extending between the two open ends.

Figure 6:
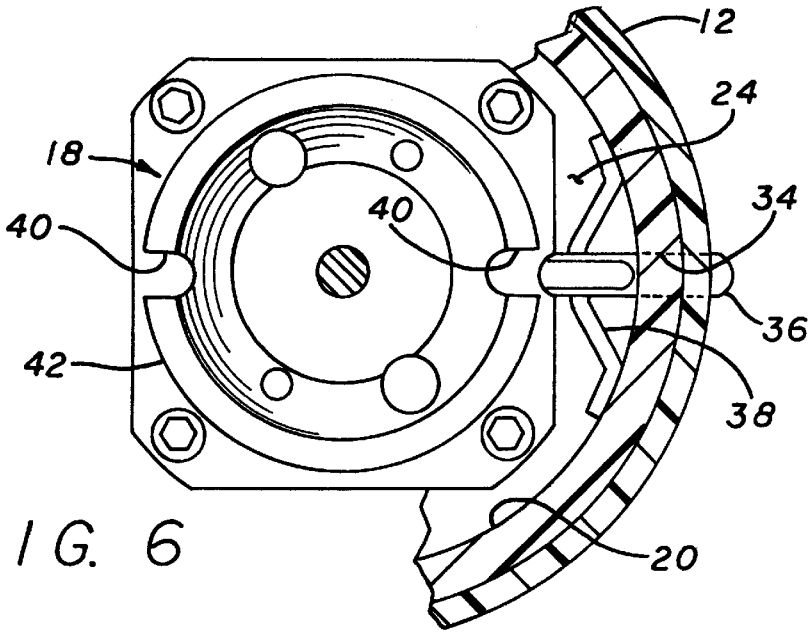
FIG. 6 is a fragmented sectional view taken along the line 6—6 of FIG. 3.

In addition, the housing 12 has an opening 34 adjacent the lower end of the housing. A relatively small tube 36 extends through the opening and is secured to the inside of the housing by a bracing member 38 welded to the inside wall of the housing. The tube is dimensioned to permit extension of a screw driver (not shown) through the tube and into engagement with one of two notches 40 formed in the periphery of a flange portion 42 of the head 18 (FIG. 6). Thus the screw driver, when extended through the tube and engaged with one of the notches, retains the head against rotation, enabling the working pad 22 to be manually rotated with respect to the head to unscrew it from the head. It will be understood that the screw driver can also be engaged with the notch in order to hold the head in place while a working pad is screwed into the head.

The housing 12 is formed with yet another opening 44 that serves the purpose of evacuating air and debris from the chamber 24 (FIG. 3). An arcuate tube 46 is connected at one end 48 to the opening 44 and includes a second end 50 configured to engage a hose 52 that leads to a vacuum unit 54 (shown in phantom in FIG. 1). The vacuum unit operates to maintain a vacuum within the chamber in order to draw particles abraded from the work surface into a collection bag 56 (shown in phantom in FIG. 1).

The abrading and polishing tool 10 further includes a handle 58, comprising a generally tubular handle member (not shown) including an internally threaded, open first end 60 for threaded engagement with the externally threaded second end 30 of the rectangular extension member 26. The tubular handle member includes an interior passageway (not shown) that extends from the first end to an internally threaded, open second end 64 of the handle. The second end is preferably in the form of a hex nut that may be engaged by a conventional wrench or plier tool. The second end may be connected to a supply line (not shown) leading from a conventional source of air under pressure for delivering pressurized air to the motor 14. The handle further includes a generally cylindrical handle grip 70 that is extended over the tubular member and is shaped to facilitate grasping of the handle by a user.

The abrading and polishing tool 10 further includes a valve assembly 72 for selectively delivering air from the source of air under pressure to the motor 14 (FIG. 3). The valve assembly includes a flow control valve 74 housed within the rectangular extension member 26, in fluid communication with the passageway 32, and manually controllable by means of a rotatable lever 76 located beneath the rectangular extension member. The flow control valve includes a slide plate 77 connected to the lever and that extends upwardly through the rectangular extension member at least up to the passageway 32. The lever may be manipulated to different positions to vary the size of the opening by aligning the slide plate with at least a portion of the opening in the passageway, thereby varying the amount of air that is allowed to pass through the opening and varying the RPM of the drive assembly, as is described in greater detail below. It will be apparent that other types of flow control valves may also be used to vary the amount of air flow to the motor.

The valve assembly 72 further includes a manually actuated spring-pressed ball valve 78 that is housed in the rectangular extension member 26 downstream of the flow control valve 74 and likewise in communication with the passageway 32. The spring-pressed ball valve includes an actuating stem 80 that is engaged by a manually depressible handle 82 pivotally connected to the tool 10 by screws 84 (FIG. 1) for movement between operating and non-operating positions, the non-operating position being shown in FIGS. 1 and 3. Thus, depression of the handle 82 opens the ball valve and thus the passageway to allow air to flow from the source of air to the pneumatic motor 14 to actuate it.

Figure 2:
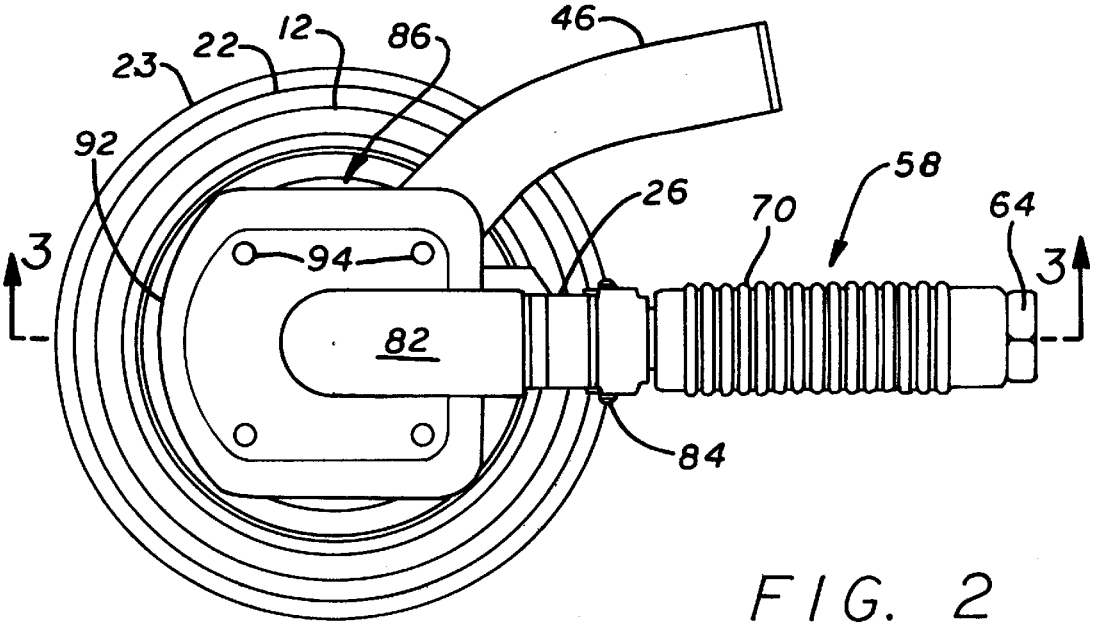
FIG. 2 is a top plan view of the polishing and abrading tool of FIG. 1.
Figure 4:
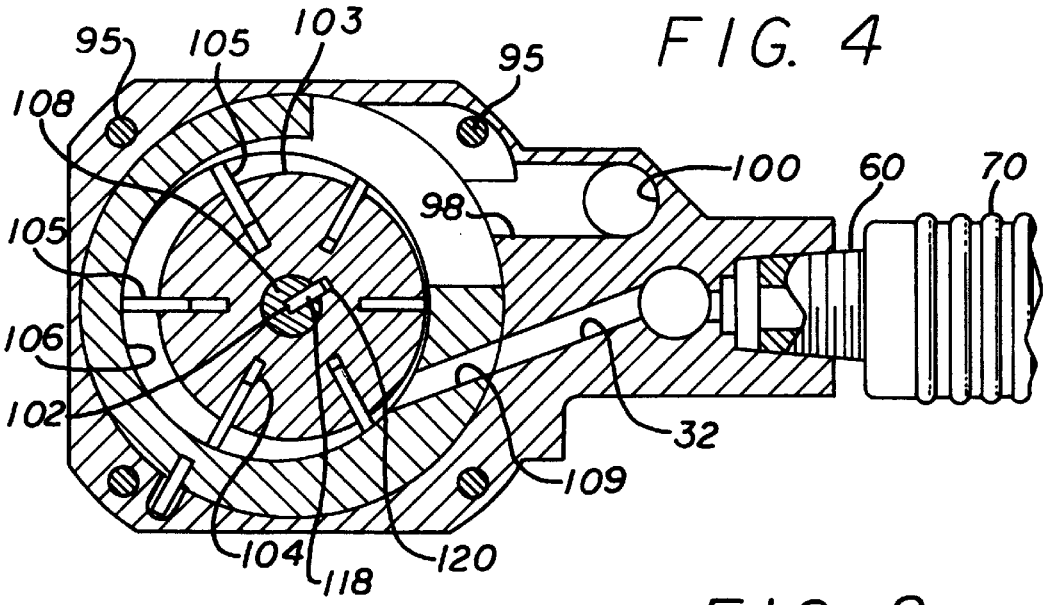
FIG. 4 is a horizontal sectional view taken along the line 4—4 of FIG. 3.

The abrading and polishing tool 10 further includes an upper handle element 86 that may be grasped by a user during use of the tool. The handle element is formed of a compressible material such as rubber, and is configured to fit about the upper portion of the housing 12. The handle element includes a top wall 88 and side walls 90 extending downwardly over the respective sides of the housing. The handle element further includes a rounded front end portion 92 that projects outwardly from the top wall to create a better fit in a user's palm. The handle element includes plural spaced apart, downwardly extending bores 94 (FIG. 2) that align with threaded bores 95 formed in the housing (FIG. 4), and through which screws may be extended to securely engage the handle element with the housing 12.

The abrading and polishing tool 10 further includes an air evacuating line 96 (FIG. 3), including a first end extending through an opening 98 in the housing 12, and including a second end connected to a passageway 100 formed in the rectangular extension member 26 that extends to the downstream end of the motor chamber. The evacuation line draws air from the downstream end of the motor chamber and directs the air into the housing chamber 24 to allow the air to escape from the motor chamber. The air is then drawn through opening 44 by the vacuum unit 54.

Referring now to FIGS. 3, 4, 5, and 7, there is shown the motor 14 and drive assembly 16. The motor comprises a pneumatically driven motor of well known design to those of ordinary skill in the art. The motor includes a rotor 103 that is pneumatically driven to rotate about the main axis, and defines a main central axis 102 of the tool 10. The motor includes plural circumferentially spaced, radially projecting slots 104 formed in the rotor within which radially movable vanes 105 are received. The motor defines a chamber 106 that is cylindrical about an axis 108 offset from the central axis. Thus the individual chambers defined between adjacent vanes change in volume as the rotor rotates, so that the air introduced into the chamber causes the rotor to rotate about the main axis. As described above, the air under pressure flows through the passageway 32, through a passage 109 and into the motor chamber, where it serves to rotate the rotor 103. The air is then evacuated from the motor chamber through the passageway 100.

The drive assembly 16 includes a drive shaft 110 journaled for rotation relative to the housing 12 by means of a pair of bearing assemblies 112 that are press fit into respective receptacles 114 formed in the housing 12 (FIG. 3). The bearing assemblies 112 preferably comprise ball bearing assemblies, each including an outer race, an inner race, and plural balls contained between the races and riding in grooves formed therein. The drive shaft extends through a central opening formed in the rotor 103 and further includes an axially extending groove 116 at a predetermined location thereon for engagement with a key 118 that is received partially within the groove 116 and partially within a groove 120 formed on the rotor 103. Thus the drive shaft is keyed rotatively to the rotor for rotation therewith.

Figure 7:
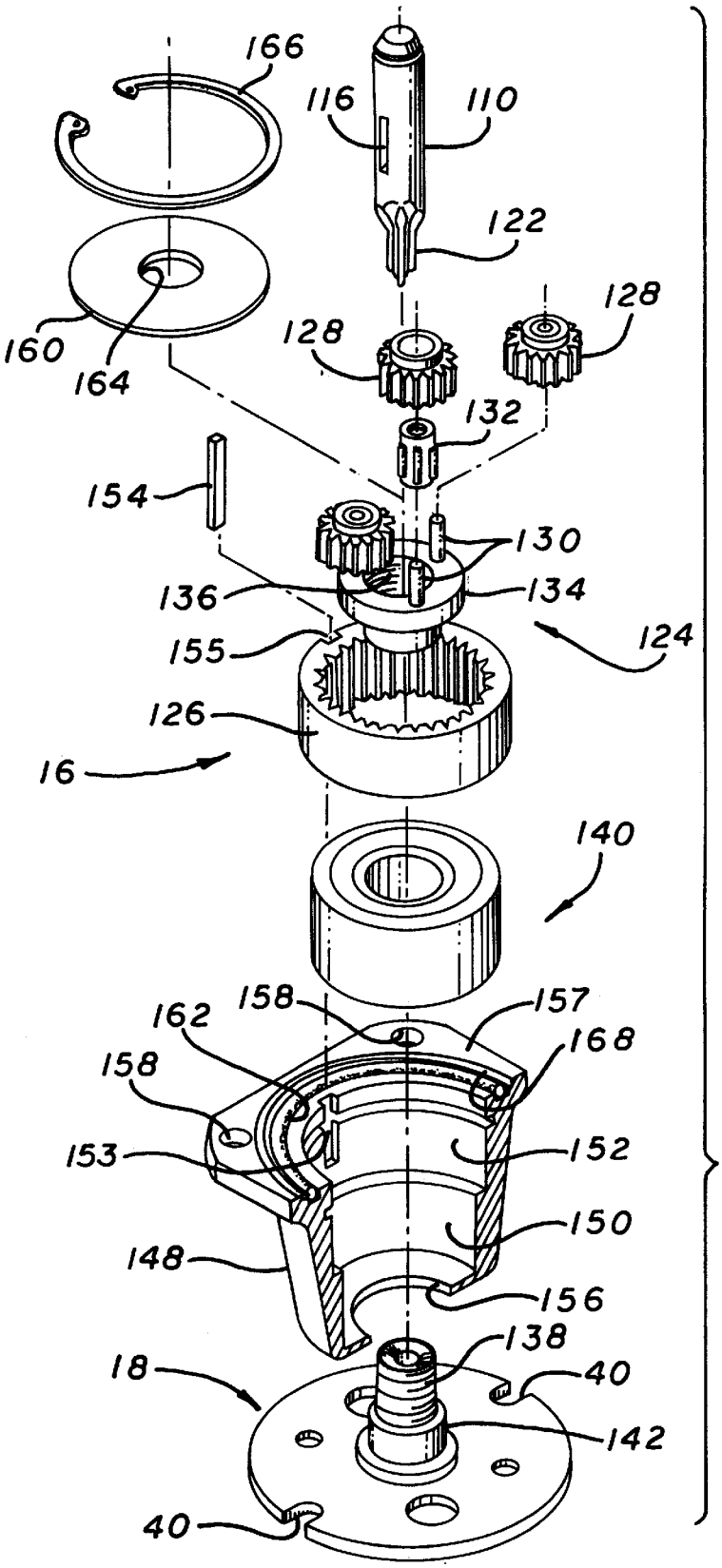
FIG. 7 is an exploded perspective view of the drive assembly included in the polishing and abrading tool of FIG. 1.

The drive shaft 110 is formed at the bottom end with a pinion gear portion 122 having a reduced cross-sectional diameter compared to the cylindrical portion of the shaft (FIG. 7). The pinion gear portion is engaged with a planetary gear assembly 124. The planetary gear assembly includes a planet or internal gear 126 and plural satellite gears 128 meshed with the teeth of the planet gear. In the embodiment shown, the drive assembly includes three such satellite gears. The satellites are each journaled for rotation onto respective spindles 130 via roller bearing assemblies 132. The spindles are integrally formed on a driver 134 that includes an internally threaded central opening 136 that is securely engaged with a threaded shaft portion 138 of the head 18. Thus, with the planet gear fixed in position, rotation of the shaft 110 and its pinion gear portion 122 causes the satellite gears to orbit about the shaft, in turn causing the driver 134 and thus the head 18 engaged thereto to rotate as well. An axial screw 135 includes a hexagonal recess formed in the upper end thereof for receipt of an allen wrench to selectively lock the shaft portion 138 of head 18 and driver 134 together.

The drive assembly 16 further includes a double bearing assembly 140 that engages a central shaft portion 142 of the head 18 adjacent the lower end of the head. In one preferred embodiment the bearing assembly comprises a double row ball bearing assembly including outer and inner races that define a pair of spaced apart tracks to receive two sets of balls (FIG. 3). Alternatively, the bearing assembly may comprise the combination of a thrust bearing 144 and needle bearing 146 spaced from the thrust bearing, as described in greater detail below in connection with FIG. 8. By incorporating a double bearing assembly rather than a conventional single bearing assembly, the central shaft of the head is maintained in virtually perfect alignment with the main axis 102 and substantially prevents any radial play of the head. It has been found that by incorporating the double row ball bearing assembly, the radial play, also known as "wobble", is maintained within a range of about one to five ten-thousandths of an inch (0.0001–0.0005 inches or 0.00025–0.0013 cm) during use of the tool 10. This serves to maintain the gear assembly 124 in the proper meshed relationship. It will be apparent that a significantly higher degree of wobble can result in the gears being stripped, thereby requiring burdensome disassembly of the tool and change-out of the gear assembly.

The planet gear 126 and bearing assembly 140 are each housed in an upwardly opening receptacle 148. The receptacle is formed with a pair of seats 150 and 152 that are sized for press fitting engagement with, respectively, the outer race of the bearing assembly and with the planet gear. The seat 152 includes an axially extending groove 153 in the side wall thereof that receives a portion of a key 154 that also engages a groove 155 formed in the planet gear. Thus the planet gear and receptacle are locked together to prevent relative rotation between the two. The receptacle includes a central opening 156 at the lower end thereof for extension therethrough of the central shaft portion 142 of the head 18. The receptacle includes at the upper end a flange 157 including plural spaced apart openings 158 that receive screws to engage the bores 95 in the housing 12 and thereby mount the receptacle to the housing 12.

Referring to FIG. 7, the tool 10 further includes a cover 160 that nests in a seat 162 in the receptacle 148 and serves to maintain the satellite gears 128 in place on the spindles 130. The cover includes a central opening 164 for extension of the drive shaft 110 therethrough. A split ring 166 is received in an undercut groove 168 in the receptacle to keep the cover securely in place over the satellite gears.

The head 18 includes a central, downwardly opening threaded bore 170 that receives a screw 172 carried by the working pad 22 to engage the working pad and head together. As described above, a screw driver is preferably extended through the tube 36 and engaged with one of the notches 40 in the head 18. The working pad is then aligned with the head and rotated in a clockwise direction relative to the head to positively engage the head and working pad together.

In use, a user may grasp the polishing and ablating tool 10 and carry the tool to a work surface 23. The user next engages a suitable working pad 22 with the head 18 in the manner described above, the particular working pad depending on the function to be performed. The user then engages an air line (not shown) with the inlet end 64 of the handle 58, the air line leading to a source of air under pressure (not shown). The user may then adjust the flow control valve 74 as needed by rotating the lever 76. The outlet 50 is connected to exhaust line 52 to withdraw air and debris from the housing chamber 24. The user then applies the tool to the work surface and presses down on the depressible handle 82 to open the valve 78, thereby allowing pressurized air to flow to the motor 14 to actuate the motor. This causes the drive assembly 16 to operate, thereby rotating the head 18 and thus the working pad 22 engaged with the head. The user then moves the tool over the work surface to perform the desired function (polishing, sanding, and the like). As the tool operates, the double bearing assembly 140 disposed adjacent the lower end of the head 18 serves to prevent undesirably high levels of radial play, thereby maintaining the internal components of the tool in proper relative positions and preventing premature failure of those components.

Figure 8:
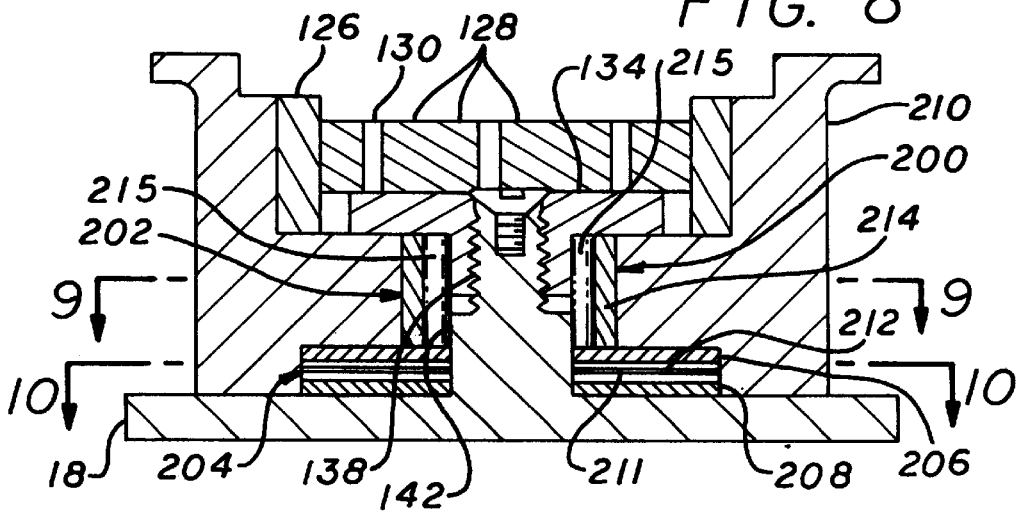
FIG. 8 is a vertical sectional view of a drive assembly constructed according to the invention, showing an alternative form of the double bearing assembly of the present invention.
Figure 9:
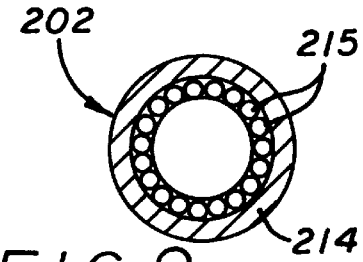
FIG. 9 is a horizontal cross-sectional view taken along the line 9—9 of FIG. 8 and showing a needle bearing assembly of the alternative embodiment of FIG. 8, in enlarged scale.
Figure 10:
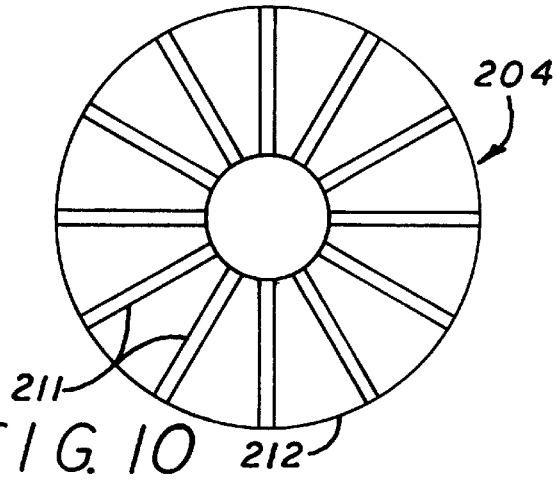
FIG. 10 is a horizontal cross-sectional view taken along the line 10—10 of FIG. 8 and showing a thrust bearing assembly of the alternative embodiment of FIG. 8, in enlarged scale.
Figure 5:
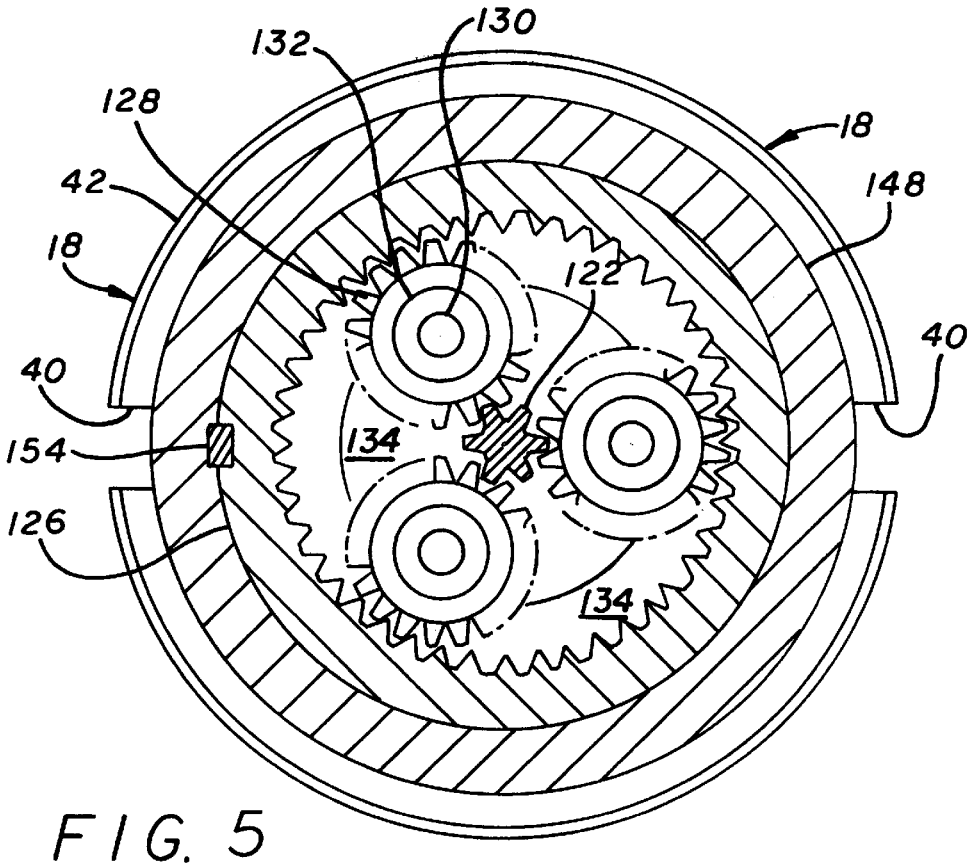
FIG. 5 is a horizontal sectional view taken along the line 5—5 of FIG. 3 and shown in enlarged scale.

Referring now to FIG. 8, there is shown an alternative embodiment of a double bearing assembly 200 included in the polishing and ablating tool 10 of the present invention. The bearing assembly includes a needle bearing assembly 202 (FIG. 9), a thrust bearing assembly 204 (FIG. 10), and a pair of thrust washers 206 and 208. The top thrust washer 206 is received against a seat formed in a receptacle 210 similar to receptacle 148 and is thus held firmly in place relative to the receptacle. The bottom washer 208 bears against the head 18. The thrust bearing comprises plural needles 211 contained in a cage 212, the needles extending radially from the central axis 102. The needle bearing assembly comprises a housing 214 containing plural needles 215 that extend in an axial or vertical direction and engage the shaft portion 142 of head 18. Thus, the thrust bearing and needle bearing assemblies allow for free rotation of the head and provide support against the receptacle 210, while simultaneously serving to prevent excessive amounts of radial play of the shaft during operation of the tool 10.

From the foregoing, it will be appreciated that the polishing and ablating tool 10 of the present invention is compact, reliable, and easy to use. Furthermore, the tool eliminates vibration and substantially prevents any radial play of the drive assembly to increase the useful life of the tool.

While forms of the invention have been illustrated and described, it will be apparent to those skilled in the art that various modifications and improvements may be made without departing from the spirit and scope of the invention. As such, it is not intended that the invention be limited, except as by the appended claims.

What is claimed is:

1. An abrading or polishing tool comprising:

a housing;

a motor mounted in the housing;

a drive assembly contained at least partially in the housing and engaged with the motor to be driven by the motor, the drive assembly including a planetary gear assembly;

a head engaged with the drive assembly and including a spindle, the spindle being rotated during operation of the motor, the head being configured to engage a working pad; and a double bearing assembly engaged with a portion of the spindle adjacent the lower end of the spindle;

the drive assembly including a drive shaft comprising a portion driven by the motor, the drive shaft further including a pinion gear portion engaged with the planetary gear assembly, the drive shaft being journaled to the housing for rotation relative to the housing;

the drive assembly still further including a driver engaged to the head for rotation therewith; and the planetary gear assembly including plural satellite gears journaled on the driver and a planet gear meshed with the respective satellite gears, the pinion gear portion of the drive shaft being engaged to the satellite gears, whereby rotation of the drive shaft causes the satellite gears to orbit relative to the planet gear and causes the drive and head to rotate.

2. The abrading or polishing tool of claim 1 wherein:

the double bearing assembly substantially prevents radial play of the spindle.

3. The abrading or polishing tool of claim 1 wherein:

the double bearing assembly comprises two rows of ball bearings axially spaced apart from one another.

4. The abrading or polishing tool of claim 1 wherein:

the double bearing assembly comprises a needle bearing and thrust bearing, each of which is engaged with the spindle.

5. The abrading or polishing tool of claim 1 wherein:

the housing defines a downwardly opening chamber through which at least a portion of said drive assembly extends.

6. The abrading or polishing tool of claim 5 wherein the housing includes a peripheral wall formed with an opening therein, and an exhaust conduit connected to said opening and operative to withdraw debris from the chamber.

7. The abrading or polishing tool of claim 1 wherein:

the motor comprises a pneumatic motor; and the housing includes an air inlet configured to engage a source of air under pressure, the air inlet leading to the motor to conduct air under pressure to the motor.

8. The abrading or polishing tool of claim 7 and further including:

a manually controllable valve attached to the housing and in fluid communication with the air inlet to selectively open the air inlet.

9. The abrading or polishing tool of claim 1 wherein:

the double bearing assembly limits radial play of the spindle to no greater than about five ten-thousandths of an inch.

10. An abrading or polishing tool comprising:

a housing;

a motor contained in the housing;

a drive assembly engaged to said motor, said drive assembly including a drive shaft that is rotated by said motor and a planetary gear assembly engaged with the drive shaft;

a head engaged with the drive assembly to be rotated by the drive assembly, the head including a spindle and configured to engage a working pad; and a bearing assembly including two rows of ball bearings spaced axially from one another, the bearing assembly being engaged with the spindle;

the drive assembly including a driver engaged to the head for rotation therewith; and the planetary gear assembly including plural satellite gears journaled on the driver and a planet gear meshed with the respective satellite gears, the drive shaft having a pinion gear portion engaged with the satellite gears, whereby rotation of the drive shaft causes the satellite gears to orbit about the planet gear and causes the driver and head to rotate.

11. The abrading or polishing tool of claim 10 wherein:

the bearing assembly substantially prevents radial play of the spindle.

12. The abrading or polishing tool of claim 10 wherein:

the housing defines a downwardly opening chamber through which at least a portion of the drive assembly extends.

13. The abrading or polishing tool of claim 12 wherein the housing includes a peripheral wall formed with an opening therein, and an exhaust conduit connected to said opening and operative to withdraw debris from the chamber.

14. The abrading or polishing tool of claim 10 wherein:

the motor comprises a pneumatic motor; and the housing includes an air inlet configured to engage a source of air under pressure, the air inlet leading to the motor to conduct air under pressure to the motor.

15. The abrading or polishing tool of claim 14 and further including:

a manually controllable valve connected to the air inlet to selectively open the air inlet.

16. The abrading or polishing tool of claim 11 wherein:

the drive assembly includes a shaft comprising a generally cylindrical portion engaged by the motor, the shaft further including a pinion gear portion engaged with the planetary gear train, the shaft being journaled to the housing through a bearing.

17. An abrading or polishing tool comprising:

a housing;

a motor mounted in the housing;

a drive assembly contained at least partially in the housing and engaged with the motor, the drive assembly including a drive shaft that is rotated by said motor and a planetary gear assembly engaged with the drive shaft;

a head engaged with the drive assembly and including a spindle, the head and spindle being rotated during operation of the motor, the head being configured to engage a working pad to abrade or polish a work surface; and a bearing assembly engaged with a portion of the spindle to substantially prevent radial play of the spindle;

the drive assembly including a driver engaged to the head for rotation therewith; and the planetary gear assembly including plural satellite gears journaled on the driver and a planet gear meshed with the respective satellite gears, the drive shaft having a pinion gear portion engaged with the satellite gears, whereby rotation of the drive shaft causes the satellite gears to orbit about the planet gear and causes the driver and head to rotate.

* * * * *